US010493344B1

(12) United States Patent
Mueller

(10) Patent No.: US 10,493,344 B1
(45) Date of Patent: Dec. 3, 2019

(54) ILLUMINATED BIRDIE SYSTEM

(71) Applicant: Steven Mueller, Clearwater, FL (US)

(72) Inventor: Steven Mueller, Clearwater, FL (US)

( * ) Notice: Subject to any disclaimer, the term of this patent is extended or adjusted under 35 U.S.C. 154(b) by 0 days.

(21) Appl. No.: 16/271,225

(22) Filed: Feb. 8, 2019

(51) Int. Cl.
*A63B 67/18* (2016.01)
*A63B 67/197* (2016.01)
*A63B 102/04* (2015.01)

(52) U.S. Cl.
CPC ..... *A63B 67/197* (2016.01); *A63B 2102/04* (2015.10); *A63B 2207/02* (2013.01)

(58) Field of Classification Search
CPC ..... A63B 67/197; A63B 2102/04; A63B 2207/02
USPC ..... 473/579
See application file for complete search history.

(56) References Cited

U.S. PATENT DOCUMENTS 5,562,290 A * 10/1996 Wei ..... F21K 2/06 273/DIG. 24
5,720,651 A * 2/1998 Chien ..... A63B 43/06 415/115
6,142,894 A * 11/2000 Lee ..... A63B 43/00 446/397
6,780,130 B1 * 8/2004 Monochello ..... A63B 67/187 473/570
8,147,359 B2 * 4/2012 Ng ..... A63B 67/197 473/579
8,827,848 B1 * 9/2014 Washburn ..... A63B 67/18 473/473
2008/0139347 A1 * 6/2008 Liao ..... A63B 67/18 473/549
2013/0040767 A1 * 2/2013 Gill ..... A63B 43/06 473/465
2014/0309059 A1 * 10/2014 Minch ..... A63B 43/06 473/422

* cited by examiner

*Primary Examiner* — Alexander R Niconovich

(57) ABSTRACT

A striking subassembly has lower and upper components. The lower component has a hemispherical lower section and a cylindrical upper section. A chamber within the lower component terminates above with an annular projection. The upper component has upper and lower disks. An annular recess is between the upper and lower disks offset from the annular projection. Feathers extend upwardly from the upper disk. An electrical assembly has a printed circuit board with a periphery. The periphery is secured within the chamber to the upper component. A light emitting diode extends downwardly from the printed circuit board. A battery powers the light emitting diode.

5 Claims, 3 Drawing Sheets

ILLUMINATED BIRDIE SYSTEM

BACKGROUND OF THE INVENTION

Field of the Invention

The present invention relates to an illuminated birdie system and more particularly pertains to allowing a paddle game to be played at night while utilizing electrical control, the allowing and the utilizing being done in a safe, convenient, and economical manner.

Description of the Prior Art

The use of illuminated sporting devices is known in the prior art. More specifically, illuminated sporting devices previously devised and utilized for the purpose of playing games at night are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe an illuminated birdie system that allows playing night paddle games while utilizing electrical control in a safe, convenient, and economical manner.

In this respect, the illuminated birdie system according to the present invention substantially departs from the conventional concepts and designs of the prior art, and in doing so provides an apparatus primarily developed for the purpose of allowing the play of night paddle games while utilizing electrical control. The allowing and utilizing are done in a safe, convenient, and economical manner.

Therefore, it can be appreciated that there exists a continuing need for a new and improved illuminated birdie system which can be used for allowing the play of night paddle games while utilizing electrical control. The allowing and the utilizing are done in a safe, convenient, and economical manner. In this regard, the present invention substantially fulfills this need.

SUMMARY OF THE INVENTION

In view of the foregoing disadvantages inherent in the known types of illuminated sporting devices now present in the prior art, the present invention provides an improved illuminated birdie system. As such, the general purpose of the present invention, which will be described subsequently in greater detail, is to provide a new and improved illuminated birdie system and method which has all the advantages of the prior art and none of the disadvantages.

To attain this, from a broad perspective, the present invention, the illuminated birdie system, essentially comprises a lower component which has a hemispherical lower section and a cylindrical upper section. A chamber is within the lower component terminating above with an annular projection extending radially inwardly. The upper section is formed with an annular ledge adjacent to the lower section. An upper component includes an upper disk positioned above the annular projection. The upper component includes a lower disk positioned below the annular projection. The upper component includes an annular recess between the upper disk and the lower disk. The annular recess is positioned laterally offset from the annular projection. The upper component includes a lower cavity extending upwardly from the chamber and terminating in a lateral surface adjacent to the upper disk. The lateral surface has spaced recesses extending upwardly into the upper disk. The upper component includes an axial projection extends upwardly from the upper disk. An electrical assembly located within the lower chamber includes a printed circuit board with a periphery. A emitting diode extend downwardly from the bottom of the printed circuit board. A battery extends upward from the top of the printed circuit board to power the light emitting diode. A plurality of feathers are adhesively secured in the upper component and extend upwardly from the upper disk.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is, therefore, an object of the present invention to provide a new and improved illuminated birdie system which has all of the advantages of the prior art illuminated sporting devices and none of the disadvantages.

It is another object of the present invention to provide a new and improved illuminated birdie system which may be easily and efficiently manufactured and marketed.

It is a further object of the present invention to provide a new and improved illuminated birdie system which is of durable and reliable constructions.

An even further object of the present invention is to provide a new and improved illuminated birdie system which is susceptible of a low cost of manufacture with regard to both materials and labor, and which accordingly is then susceptible of low prices of sale to the consuming public, thereby making such illuminated birdie system economically available to the buying public.

Lastly, it is an object of the present invention to provide an illuminated birdie system to allow playing a paddle game at night while utilizing electrical control, the allowing and the utilizing being done in a safe, convenient, entertaining, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
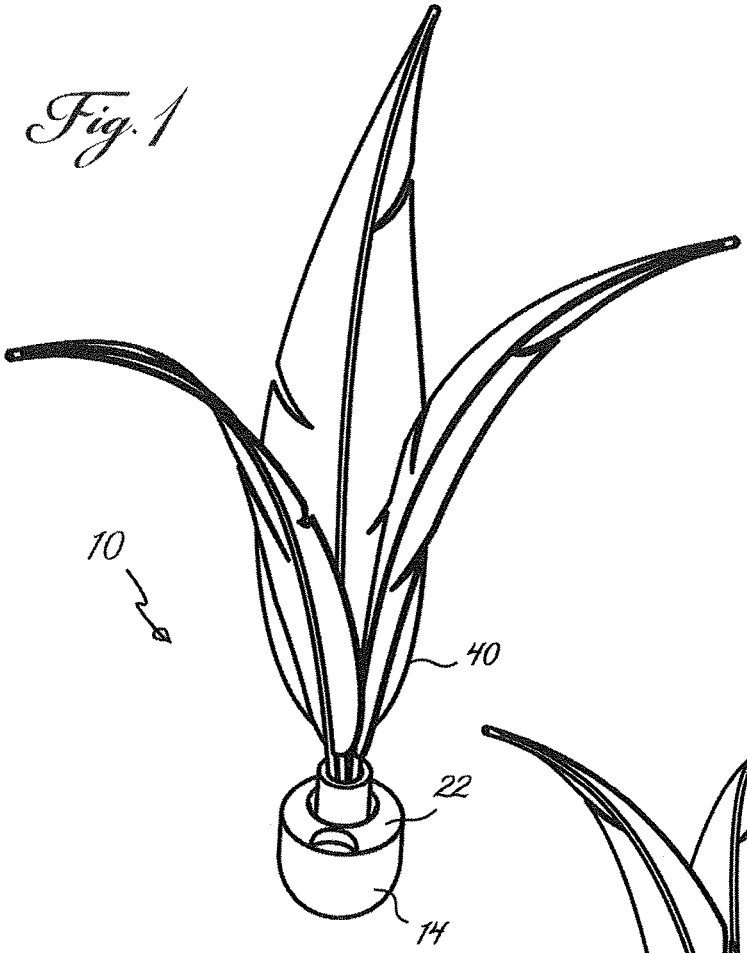
FIG. 1 is a perspective illustration of an illuminated birdie system constructed in accordance with the principles of the present invention.
Figure 2:
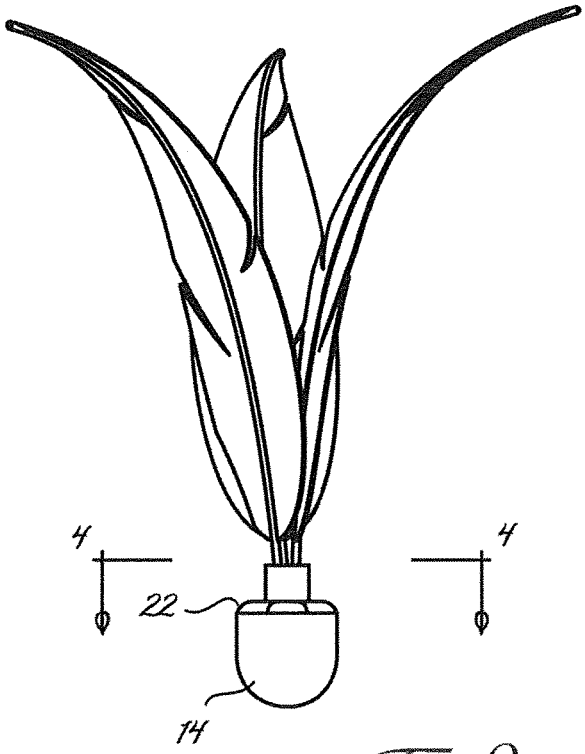
FIG. 2 is a front elevational view of the system shown in FIG. 1.
Figure 3:
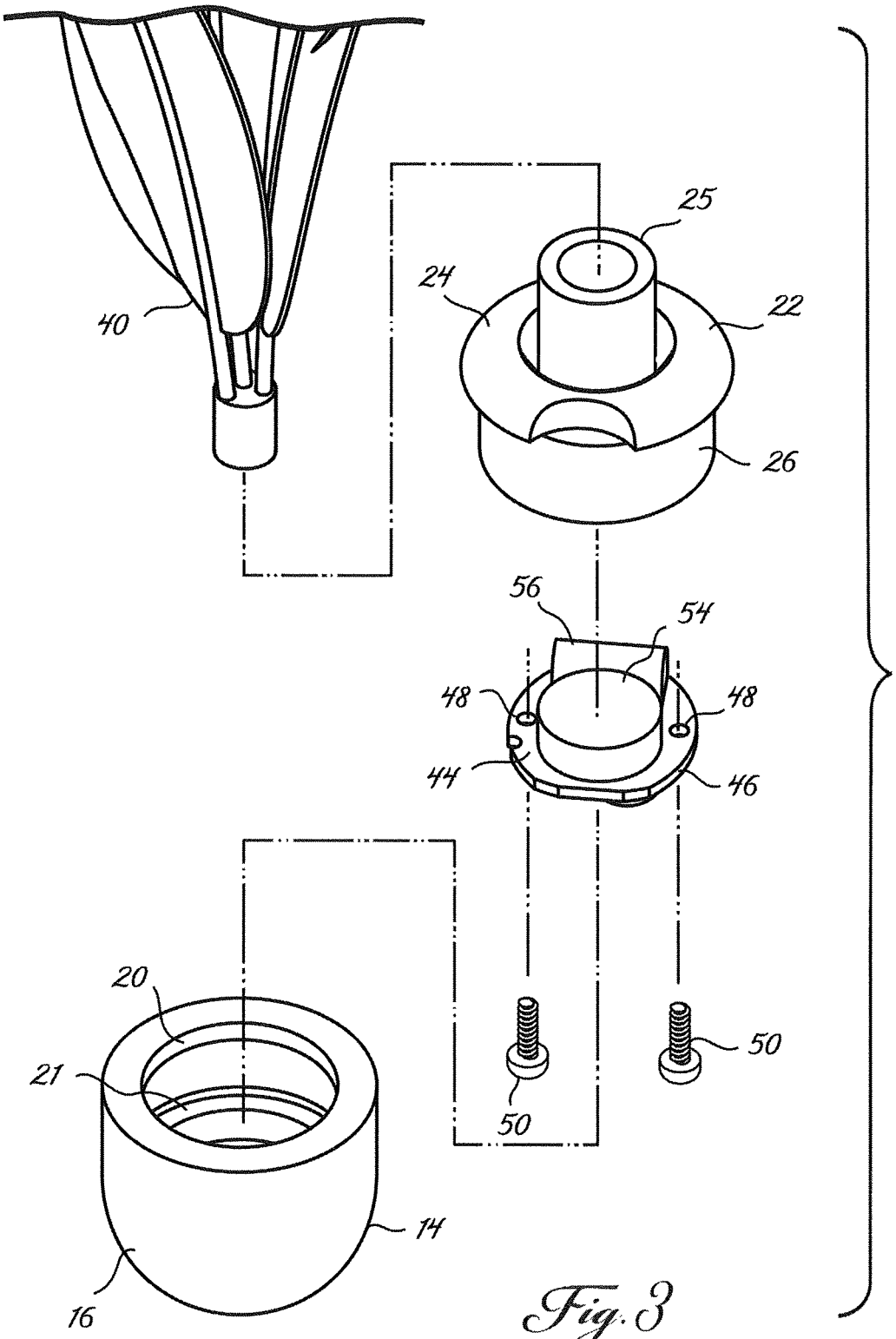
FIG. 3 is an exploded perspective illustration of the system shown in FIGS. 1 and 2.
Figure 4:
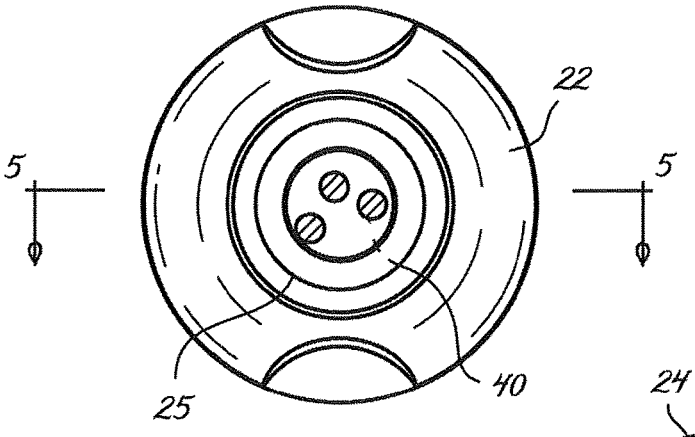
FIG. 4 is a cross sectional view taken along line 4-4 of FIG. 2.
Figure 6:
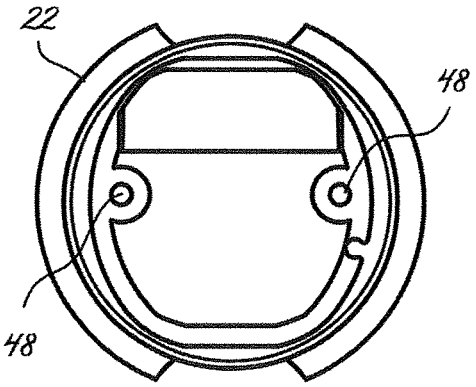
FIG. 6 is a bottom view of the upper component.
Figure 5:
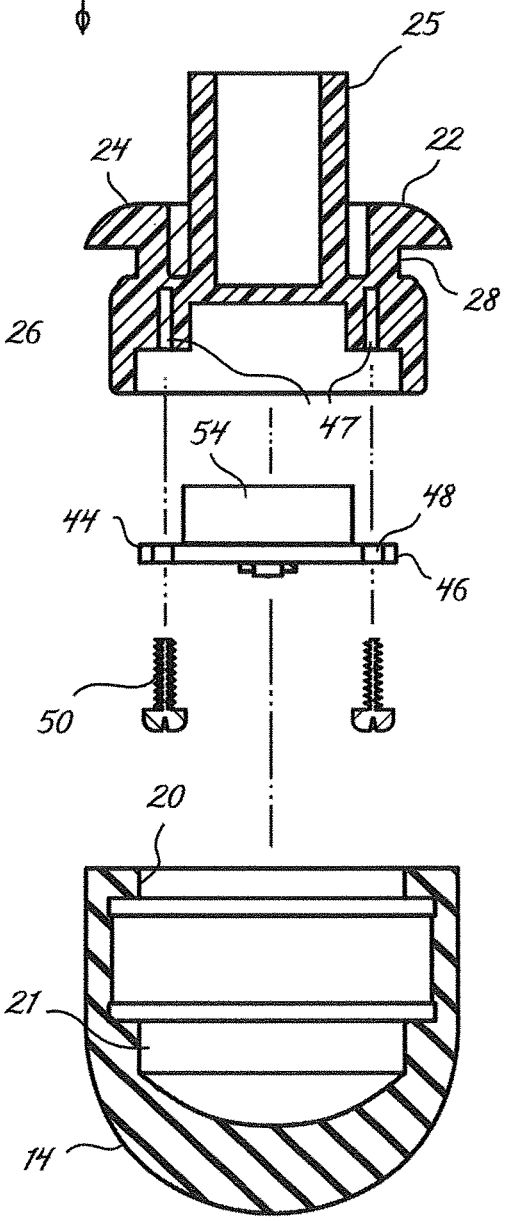
FIG. 5 is an exploded cross sectional view of the upper component, lower component, and electrical assembly taken along line 5-5 of FIG. 4.

With reference now to the drawings, and in particular to FIG. 1 thereof, the preferred embodiment of the new and improved illuminated birdie system embodying the principles and concepts of the present invention and generally designated by the reference numeral 10 will be described.

The present invention, the illuminated birdie system is comprised of a plurality of components. Such components in their broadest context include a striking subsystem with an upper component and a lower component, an electrical assembly, and feathers. Such components are individually configured and correlated with respect to each other so as to attain the desired objectives.

From a specific perspective, the invention of the present application is an illuminated birdie system 10 to allow playing the paddle game at night while utilizing electrical control in a safe, convenient, entertaining, and economical manner.

The system includes a striking subassembly having a lower component 14 and an upper component 22. The upper component is fabricated of a rigid plastic material and the lower component is fabricated of a translucent elastomeric material. The upper and lower components are securely coupled to render the system water resistant and floatable.

The lower component has a lower section 16 and an upper section 18. The lower component has an interior surface and an exterior surface. The exterior surface of the lower section has a hemispherical configuration with a first radius of curvature. The interior surface of the lower section has a hemispherical configuration with a second radius of curvature. The upper section has a cylindrical configuration with an interior surface and an exterior surface. The lower section and the upper section form a chamber with a common central axis. The first radius of curvature is greater than the second radius of curvature whereby the lower section forms a lower wall with a continuously changing thickness having a greatest thickness at the central axis. The exterior surface of the upper section is a smooth continuation of the exterior surface of the lower section. The interior surface of the upper section terminates above with an annular projection 20 extending radially inwardly. The interior surface of the upper section is formed with an annular ledge 21 adjacent to the forward section.

The upper component includes an upper disk 24 positioned above and in contact with the annular projection of the lower component. The upper component includes a lower disk 26 positioned below and in contact with the annular projection of the lower component. The upper component includes an annular recess 28 between the upper disk and the lower disk positioned laterally offset from and in contact with the annular projection of the lower component. The lower disk has a lower cavity extending upwardly from the chamber and terminating in a lateral surface adjacent to the upper disk. The lateral surface has spaced recesses 47 extending upwardly into the upper disk. An axial projection 25 extends upwardly from the upper disk. The upper disk and the axial projection and the annular recess and the lower disk and the lower cavity have an axis co-extensive with the common central axis. The lower disk has a lower diameter and the upper disk has an upper diameter. The upper diameter is greater than the lower diameter.

Next provided is an electrical assembly 44. The electrical assembly is located within the chamber. The electrical assembly includes a printed circuit board 46 with a top, a bottom, and a periphery. The periphery of the printed circuit board has spaced apertures 48. Threaded fasteners 50 extend through the spaced apertures and into the spaced recesses to secure the printed circuit board to the upper component. A light emitting diode 52 extends downwardly from the bottom of the printed circuit board. A battery 54 and a motion sensor 56 extend upwardly from the top of the printed circuit board to power the light emitting diode. The motion sensor is adapted to turn on the light emitting diode when the system is hit or shaken. The light emitting diode remain lit for a predetermined period, such as 15 seconds, after being turned on or until the system is hit or shaken again. When the system is struck, hit or shaken again, the light emitting diode will again remain lit for an additional predetermined period, such as 15 seconds. This sequence is repeated while play continues and while the battery remains viable. The battery life in the preferred embodiment is 24 hours. Peripheral finger notches 58 are formed in the upper disk to facilitate separating the upper component and the lower component to change the battery and to turn the light emitting diode on and off.

Lastly, a plurality of feathers 40 are provided. Each of the feathers has a lower end adhesively secured in the axial projection. Each of the feathers has an upper end extending upwardly from the upper component. The preferred feathers are goose feathers, but a variety of different types of feathers, natural and synthetic, may be substituted therefor.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An illuminated birdie system comprising:

a striking subsystem having a lower component and an upper component;

the lower component having a hemispherical lower section and a cylindrical upper section, a chamber within the lower component terminating above with an annular projection extending radially inwardly;

the upper component including an upper disk positioned above the annular projection, the upper component including a lower disk positioned below the annular projection, the upper component including an annular recess between the upper disk and the lower disk, the annular recess being positioned laterally offset from the annular projection, the upper component including a lower cavity extending upwardly from the chamber and terminating in a lateral surface within the lower disk, the lateral surface having spaced recesses extending upwardly into the upper disk, the upper component including an axial projection in a cylindrical configuration extending upwardly from the upper disk;

an electrical assembly located within the chamber, the electrical assembly including a printed circuit board with a top and a bottom and a periphery, the periphery of the printed circuit board having spaced apertures, threaded fasteners extending through the spaced apertures and into the upper disk for securing the printed circuit board to the upper component, a plurality of light emitting diode extending downwardly from the bottom of the printed circuit board, a battery extending upwardly from the top of the printed circuit board to power the light emitting diode, a sensor for activating the light emitting diode upon the subsystem being struck by a paddle and for inactivating the light emitting diode after passage of a predetermined time; and a plurality of feathers having lower ends adhesively secured within the axial projection and extending upwardly from upper component.

2. The illuminated birdie system as set forth in claim 1 wherein the lower disk has a lower diameter and the upper disk has an upper diameter, the upper diameter being greater than the lower diameter.

3. The illuminated birdie system as set forth in claim 1 wherein the upper component is fabricated of a rigid plastic material.

4. The illuminated birdie system as set forth in claim 1 wherein the lower component is fabricated of a translucent elastomeric material.

5. An illuminated birdie system (10) for a paddle game to allow playing the paddle game at night while utilizing electrical control, the system comprising, in combination:

a striking subsystem having a lower component (14) and an upper component (22), the upper component being fabricated of a rigid plastic material, the lower component being fabricated of a translucent elastomeric material, the upper component and the lower component being securely coupled to render the system water resistant and floatable;

the lower component having a lower section (16) and an upper section (18), the lower component having an interior surface and an exterior surface, the exterior surface of the lower section having a hemispherical configuration with a first radius of curvature, the interior surface of the lower section having a hemispherical configuration with a second radius of curvature, the upper section having a cylindrical configuration with an interior surface and an exterior surface, the lower section and the upper section forming a chamber with a common central axis, the first radius of curvature being greater than the second radius of curvature whereby the lower section forms a lower wall with a continuously changing thickness having a greatest thickness at the central axis, the exterior surface of the upper section being a smooth continuation of the exterior surface of the lower section, the interior surface of the upper section terminating above with an annular projection (20) extending radially inwardly, the interior surface of the upper section being formed with an annular ledge (21) adjacent to the lower section;

the upper component including an upper disk (24) positioned above and in contact with the annular projection, the upper component including a lower disk (26) positioned below and in contact with the annular projection, the upper component including an annular recess (28) between the upper disk and the lower disk positioned laterally offset from and in contact with the annular projection, the upper component including a lower cavity extending upwardly from the chamber and terminating in a lateral surface within the lower disk, the lateral surface having spaced recesses (47) extending upwardly into the upper disk, an axial projection (25) having a cylindrical configuration extending upwardly from the upper disk, the upper disk and the axial projection and the annular recess and the lower disk and the lower cavity having an axis co-extensive with the common central axis, the lower disk having a lower diameter, the upper disk having an upper diameter, the upper diameter being greater than the lower diameter;

an electrical assembly (44) located within the chamber, the electrical assembly including a printed circuit board (46) with a top and a bottom and a periphery, the periphery of the printed circuit board having spaced apertures (48), threaded fasteners (50) extending through the spaced apertures and into the spaced recesses for securing the printed circuit board to the upper component, a plurality of light emitting diode (52) extending downwardly from the bottom of the printed circuit board, a battery (54) and a motion sensor (56) extending upwardly from the top of the printed circuit board to power the light emitting diode, the motion sensor adapted to turn on the light emitting diode when the system is struck, the light emitting diode remaining lit for predetermined period after being turned on, when the system is struck again the light emitting diode will again remain lit for an additional period of time, the turning on of the light emitting diode continues while play continues and the battery remains viable; and a feather subsystem having a plurality of feathers (40), each of the feathers having a lower end adhesively secured within the axial projection, each of the feathers having an upper end extending upwardly from the upper component.

* * * * *